US008251002B2

(12) United States Patent
Wang et al.

(10) Patent No.: US 8,251,002 B2
(45) Date of Patent: Aug. 28, 2012

(54) PONTOON-TYPE FLOATING STRUCTURE

(75) Inventors: Chien Ming Wang, Singapore (SG); Tianyun Wu, Singapore (SG); Yoo Sang Choo, Singapore (SG); Kok Keng Ang, Singapore (SG); Ah Cheong Toh, Singapore (SG); Ah Mui Hee, Singapore (SG)

(73) Assignees: National University of Singapore, Singapore (SG); Maritime and Port Authority of Singapore, Singapore (SG); Jurong Consultants PTE Ltd., Singapore (SG)

( * ) Notice: Subject to any disclaimer, the term of this patent is extended or adjusted under 35 U.S.C. 154(b) by 568 days.

(21) Appl. No.: 12/090,066

(22) PCT Filed: Oct. 14, 2005

(86) PCT No.: PCT/SG2005/000356

§ 371 (c)(1),
(2), (4) Date: Apr. 23, 2009

(87) PCT Pub. No.: WO2007/043975

PCT Pub. Date: Apr. 19, 2007

(65) Prior Publication Data

US 2009/0217855 A1 Sep. 3, 2009

(51) Int. Cl.
*B63B 39/03* (2006.01)

(52) U.S. Cl. ..... 114/125

(58) Field of Classification Search ..... 114/125, 114/263

See application file for complete search history.

(56) References Cited

U.S. PATENT DOCUMENTS

| | | | | |
|---|---|---|---|---|
| 3,797,440 | A | 3/1974 | Pangalila | |
| 3,800,543 | A | 4/1974 | Moore | |
| 4,155,323 | A * | 5/1979 | Finsterwalder | 114/264 |
| 4,232,623 | A | 11/1980 | Chou et al. | |
| 4,366,766 | A * | 1/1983 | Bergman | 114/125 |
| 4,848,260 | A | 7/1989 | Hamilton et al. | |
| 4,972,788 | A * | 11/1990 | Berger | 114/61.15 |
| 5,875,729 | A * | 3/1999 | Simola | 114/267 |
| 5,931,113 | A | 8/1999 | Eva, III et al. | |
| 6,102,625 | A | 8/2000 | Olsen et al. | |
| 6,408,780 | B1 | 6/2002 | Ozaki et al. | |
| 2001/0037757 | A1 * | 11/2001 | Bringedal et al. | 114/264 |

FOREIGN PATENT DOCUMENTS

GB 550989 A 2/1943

(Continued)

OTHER PUBLICATIONS

Watanabe et al. "Very Large Floating Structures: Applications, Analysis and Design" Centre for Offshore Research and Engineering, National University of Singapore CORE Report No. 2004-02, Dec. 2004.

(Continued)

*Primary Examiner* — Stephen Avila
(74) *Attorney, Agent, or Firm* — Volpe and Koenig, P.C.

(57) ABSTRACT

A pontoon-type floating structure comprising an upper deck that is to be maintained above water level and that is to receive and support a load by the load resting thereon; and a horizontal array of chambers disposed underneath the upper deck, with the chambers providing a first set of chambers that provide the structure with buoyancy, and a second set of chambers with water having access thereto so that the second set of chambers, under steady state conditions, do not provide buoyancy.

25 Claims, 10 Drawing Sheets

FOREIGN PATENT DOCUMENTS

| | | | |
|---|---|---|---|
| GB | 804207 | A | 11/1958 |
| GB | 1002779 | A | 8/1965 |
| GB | 2030947 | A | 4/1980 |
| JP | 09277983 | | 10/1997 |
| JP | 2002120793 | A | 4/2002 |

OTHER PUBLICATIONS

Watanabe et al. "Hydroelastic Analysis of Pontoon-Type VLFS: A Literature Survey" Engineering Structures 26 (2004) 245-256, Jan. 2004.

"Marinefloat" by the Floating Structures Association of Japan, Tokyo.

Wang et al "Static Analysis of Floating Container Terminal: An Example to Demonstrate the Effect of Gill Cells" Centre for Offshore Research and Engineering, National University of Singapore; Maritime and Port Authority of Singapore; and Jurong Consultants Pte Ltd. pp. 1-18.

* cited by examiner

PONTOON-TYPE FLOATING STRUCTURE

FIELD OF INVENTION

The invention relates to a pontoon-type floating structure.

BACKGROUND

As population and urban development expand in land scarce island countries (or countries with long coastlines), city planners and engineers may resort to land reclamation to ease the pressure on existing heavily-used land and underground spaces. Using fill materials from seabed, hills, deep underground excavations, and even construction debris, engineers are able to create relatively vast and valuable land from the sea. However, land reclamation has its limitations. It is only suitable when the water depth is shallow (less than 20 m). When the water depth is large and/or the seabed is extremely soft, land reclamation may no longer be cost effective or even feasible. Moreover, land reclamation may destroy the marine habitat and may even lead to the disturbance of toxic sediments.

Very Large Floating Structures (VLFS) are an alternative method to create "land" on the sea. There are two types of VLFS; the semisubmersible-type and the pontoon-type. Semi-submersible type floating structures are raised above the sea level using column tubes or ballast structural elements to minimize the effects of waves while maintaining a constant buoyancy force. Thus they can reduce the wave induced motions and are therefore suitably deployed in high seas with large waves. Floating-platforms used for drilling for and production of oil and gas are typical examples of semi-submersible-type VLFSs. When these semi-submersibles are attached to the seabed using vertical tethers with high pretension as provided by additional buoyancy of the structure, they are referred to as tension-leg platforms.

In contrast, pontoon-type floating structures lie on the sea level and are typically for use in calm waters, often inside a cove or a lagoon and near the shoreline. The larger category of pontoon-type floating structures or Mega-Floats have at least one length dimensions greater than 60 m.

When a Mega-Float is heavily loaded, in the central portion for example, the floating structure will deflect with the centre vertically displaced relative to the corners. The resulting differential deflection may cause equipment to malfunction, the superstructure on the floating structure to be subjected to additional stresses or in extreme cases may lead to structural failure under high stress conditions.

A need therefore exists to address at least one of the above problems.

SUMMARY OF THE INVENTION

In accordance with a first aspect of the present invention there is provided a pontoon-type floating structure comprising an upper deck that is to be maintained above water level and that is to receive and support a load by the load resting thereon; and a horizontal array of chambers disposed underneath the upper deck, with the chambers providing a first set of chambers that provide the structure with buoyancy, and a second set of chambers with water having access thereto so that the second set of chambers, under steady state conditions, do not provide buoyancy.

A plurality of walls preferably depend from the upper deck and co-operate therewith to provide the chambers separated by the walls.

Said walls are preferably generally perpendicular to said deck, with the walls including a first set that are generally parallel and transversely spaced and a second set, with the walls of the second set being generally parallel and transversely spaced and generally normal to the first set so that the chambers in horizontal transverse cross-section are generally square or rectangular.

The chambers preferably have respective bottom walls, the bottom walls being displaced from the upper deck, with the bottom walls of said second set of chambers having an aperture providing for the flow of water.

Said second set of chambers are preferably located adjacent a periphery of said structure.

Said second set of chambers are preferably aligned in rows adjacent said periphery.

Each row is preferably displaced from the periphery by at least one chamber of the first set.

Said structure is preferably square or rectangular in configuration when viewed in plan so as to have four sides, with each row extending generally parallel to one of said sides.

Said structure is preferably formed of one or more of a group consisting of steel, concrete, and reinforced concrete.

Said structure preferably includes a generally horizontally oriented bottom slab that is to be submerged and that is generally parallel and co-terminus with respect to said top deck but vertically spaced therefrom.

Said array of chambers is preferably a first array, and said structure includes a second horizontal array of chambers located beneath the first array of chambers, the first and second chambers separated by a generally horizontally oriented middle slab and that is generally parallel and co-terminus with respect to said top deck but vertically spaced therefrom.

Said top deck preferably has apertures and/or is air pervious to provide for the flow of air with respect to the chambers of the second set.

BRIEF DESCRIPTION OF THE DRAWINGS

Example embodiments of the invention will be better understood and readily apparent to one of ordinary skill in the art from the following written description, by way of example only, and in conjunction with the drawings, in which.

DETAILED DESCRIPTION

Figure 1:
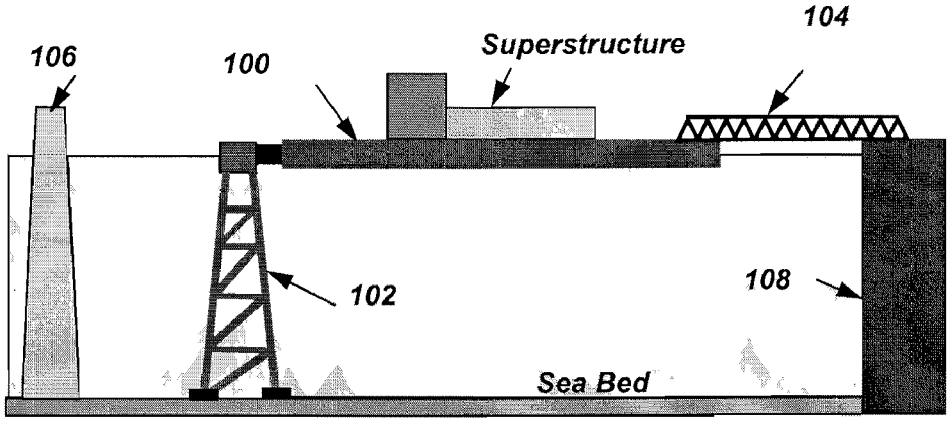
FIG. 1 is a schematic side elevation view of a floating structure according to an example embodiment.

FIG. 1 shows a floating structure 100 according to an example embodiment. The floating structure 100 may be moored to a mooring facility 102 and may include an access connection 104 to land 108, another structure or a vessel. A breakwater 106 may be optionally provided to reduce large wave forces impacting the floating structure 100.

Figure 2:
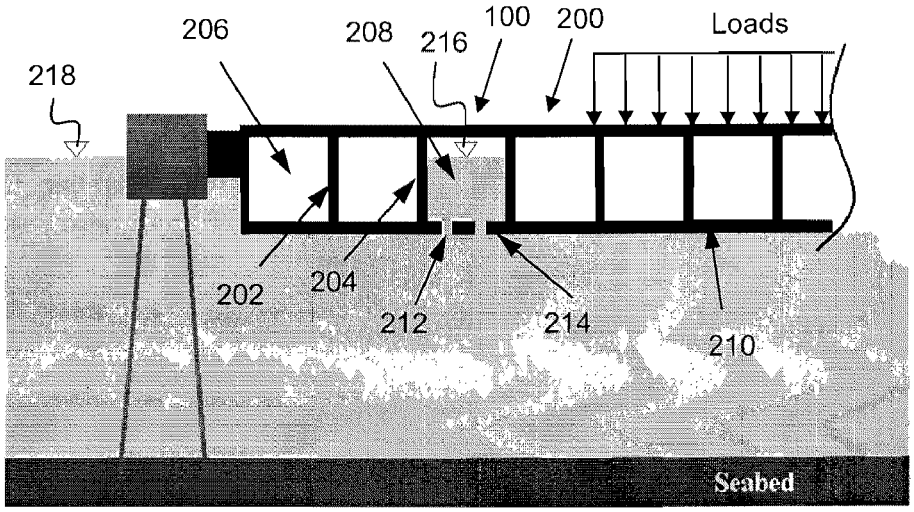
FIG. 2 is a cross sectional schematic view of a section of the floating structure of FIG. 1.

FIG. 2 shows a schematic cross sectional drawing of a section of the floating structure 100. The structure 100 includes a top deck 200 provided by a top slab in the example embodiment. Depending from the deck 200 are a plurality of walls e.g. 202, 204. The walls 202, 204 extend generally perpendicular to the deck 200 so as to provide a plurality of chambers e.g. 206, 208. The chambers 206, 208 are arranged in a horizontal array underneath the deck 200. A horizontal bottom wall or slab 210 is provided. The walls 202, 204, as well as the slab 210 are made from a water impervious material, with each of the walls 202, 204 sealingly connected to the horizontal bottom slab 210. In this respect it will be appreciated that the majority of the chambers e.g. 206 are sealingly enclosed so that water may not enter them. At the same time, apertures 212, 214 are provided in the bottom slab 210 in the area of selected chambers 208, allowing water to enter those chambers e.g. 208. To facilitate the venting of air from the chambers 208 as the water enter, the deck 200 may be provided with apertures (not shown) or may be otherwise air pervious, at least in areas of the chambers 208. Under steady state conditions, the chambers 208 are thus filled with water up to a level, indicated at 216, equivalent to the sea level, indicated at numeral 218.

As the water is free to flow in and out of the chambers 208, those chambers, which may be referred to as gill cells, provide zero-buoyancy to the floating structure 100. At the same time, the remaining chambers 206 provide buoyancy to the structure 100. Thus, buoyancy forces are acting on the bottom slab 210, apart from areas underneath the chambers 208.

In the example embodiment, the chambers 208 are provided along an edge 216 of the structure 100, and as a result of the zero-buoyancy of the chambers 208, a restraint to vertical movement of the edge 216 is provided. This was found to decrease the differential deflection of the edge 216 when loads are applied at or near the centre of the floating structure 100. By adjusting the number and geometry of the chambers 208, the floating structure 100 can be designed to maintain the differential deflection within acceptable limits under varying loads.

In the example embodiment, the apertures 212, 214 are designed such that the structural integrity of the bottom slabs 210 is maintained. The aperture size is chosen to be sufficiently large to allow water to freely enter so that the water level in the chamber is equal to the sea water level.

Figure 3A:
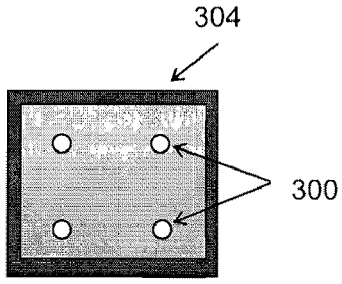
FIG. 3*a* is a schematic bottom view of a zero-buoyancy chamber of the floating structure of FIG. 1.
Figure 3B:
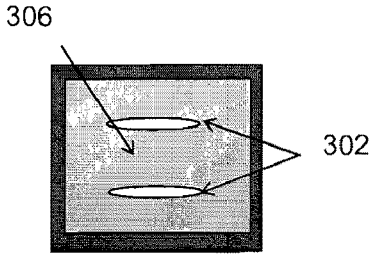
FIG. 3*b* is a schematic bottom view of another zero-buoyancy chamber of the floating structure of FIG. 1.

FIGS. 3*a* and 3*b* show example apertures 300, 302 for individual zero-buoyancy chambers 304, 306. In choosing aperture designs, sharp points in the apertures may be avoided as they can cause starting points for cracks. The size of the apertures may be balanced between avoiding weakening of the chambers' structure, and blockage of particularly small apertures.

In the example embodiment the walls and slabs are constructed from steel, concrete, reinforced concrete such as stell reinforced concrete, or any other suitable watertight material with the requisite stiffness and strength. Since watertightness of concrete avoids or limits corrosion of the reinforcement, either watertight concrete or offshore concrete may be used. For example high-performance concrete containing fly ash and silica fume would be suitable. It will be appreciated that other combinations of structural materials may be used in different embodiments.

Corrosion protection techniques may be applied to the reinforcing and other steel work using for example coatings, cathodic protection, corrosion allowance and corrosion monitoring. In areas where marine organisms are active, antifouling coatings may be used to reduce marine growth. In areas of potential severe low corrosion, such as directly beneath the mean low water level, cathodic protection may be applied, while coating methods may be applied for remaining parts shallower than the depth of 1 m below the mean low water level. Coating methods may include painting, titanium-clad lining, stainless steel lining, thermal spraying with zinc, aluminium and aluminium alloy.

Figure 4:
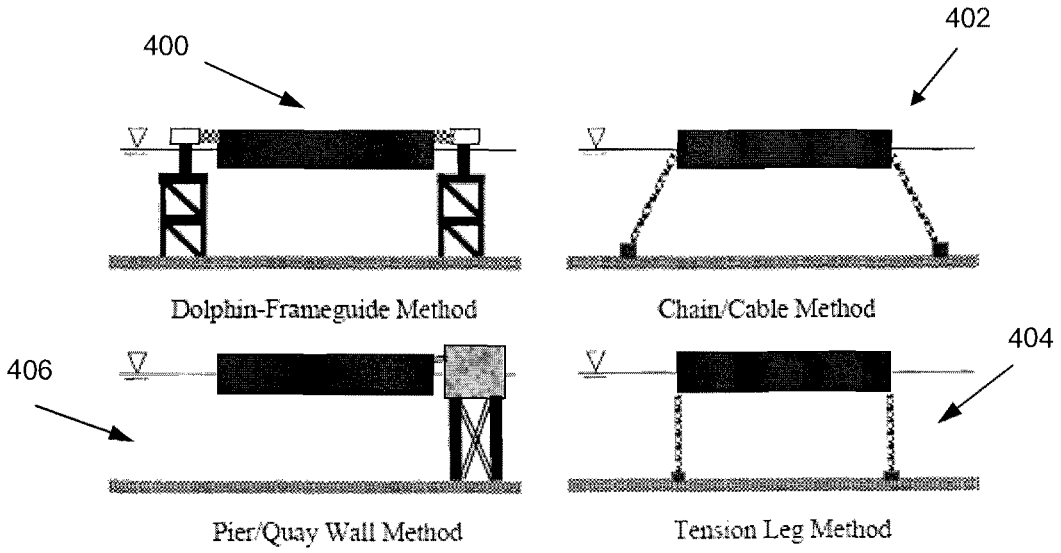
FIG. 4 shows a plurality of schematic side elevations of different mooring arrangements for the floating structure of FIG. 1.

Returning now to FIG. 1, the mooring facility 102 ensures that the floating structure 100 is kept in position so that the facilities installed on the floating structure can be reliably operated. Preventing the structure 100 from drifting away under critical sea conditions and storms is an example design consideration for a mooring facility 102. A free or drifting floating structure 100 may lead to damage to the surrounding facilities and may also lead to the loss of human life in a collision with vessels. FIG. 4 shows a number of types of mooring systems such as the dolphin-guide frame system 400, mooring by cable and chain 402, tension leg method 404 and pier/quay wall method 406. Choice of the type of mooring system depends on the local conditions and the performance requirements.

Once the type of mooring system is chosen, the shock absorbing material, the quantity and layout of devices to meet the environmental conditions and the operating conditions and requirements can be determined. Layout of mooring dolphins for example may be such that the horizontal displacement of the floating structure is adequately controlled and the mooring forces are appropriately distributed. The layout and quantity of the mooring dolphins may be adjusted so that the displacement of the floating structure and the mooring forces do not exceed the allowable values.

In order to reduce the wave forces impacting the floating structure, optionally one or more breakwaters 106, may be constructed nearby. A breakwater may be useful if the significant wave height is greater than 4 m.

Figure 5:
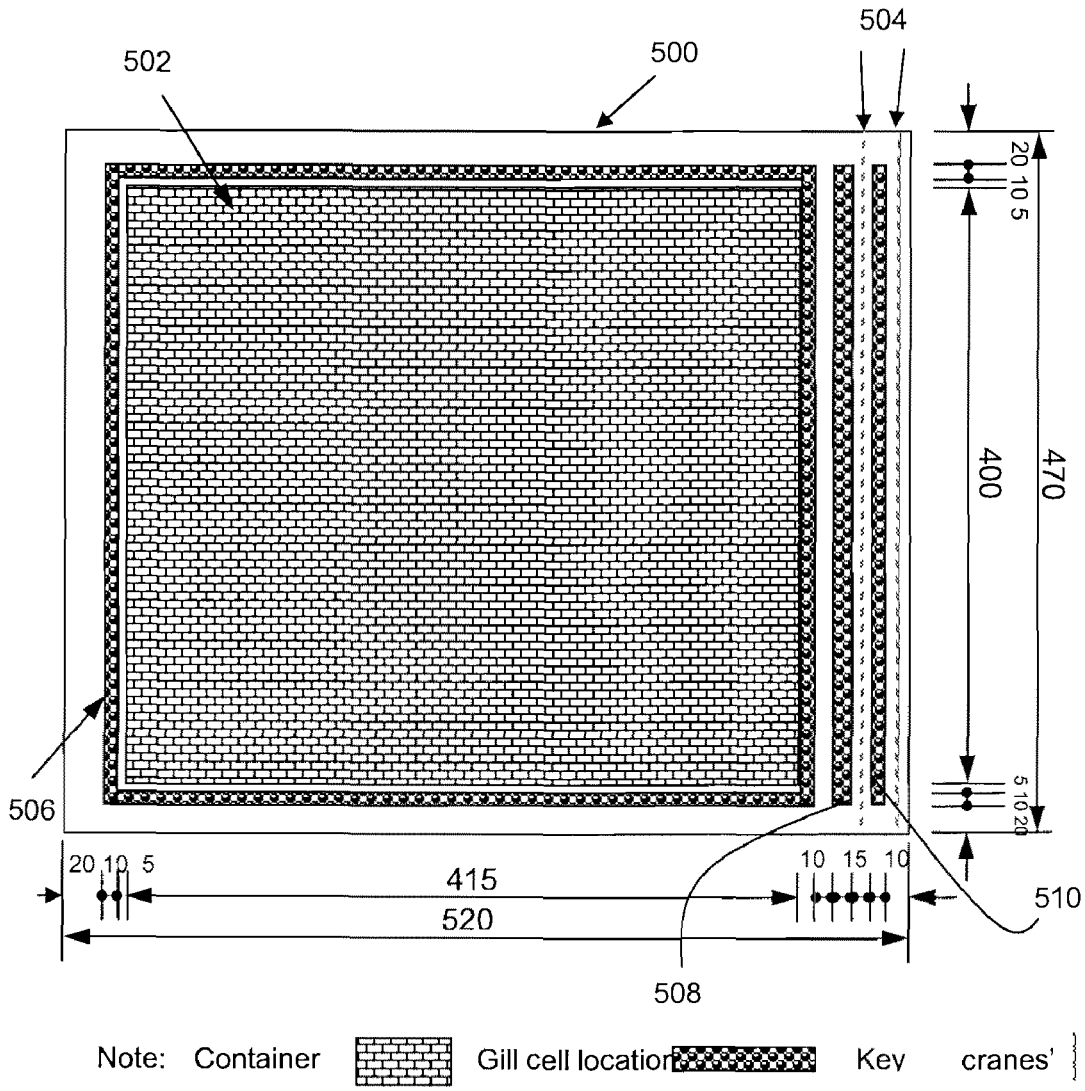
FIG. 5 is a schematic plan view of a floating structure according to another example embodiment (dimensions in metres).

In the following, results of calculations illustrating the performance of an example embodiment of the present invention will be described. FIG. 5 shows a schematic top view of a floating container terminal 500 according to the example embodiment, and used for the calculation discussed below. In FIG. 5, a central container area 502 is provided, as well as a rail area 504 at one edge of the structure 500. Dimensions indicated in FIG. 5 are in meters. The location of the zero-buoyancy chambers are schematically indicated at numerals 506, 508, and 510.

A finite element method (FEM) calculation was used to compare the structure 500 against the same structure without zero-buoyancy chambers. An example concern is the differential deflection between the corners and the middle portion of the floating structure 500. For example a quay crane may not be able to operate if the between-rail 504 gradient goes above certain gradient specification, for example 0.4%.

Figure 6A:
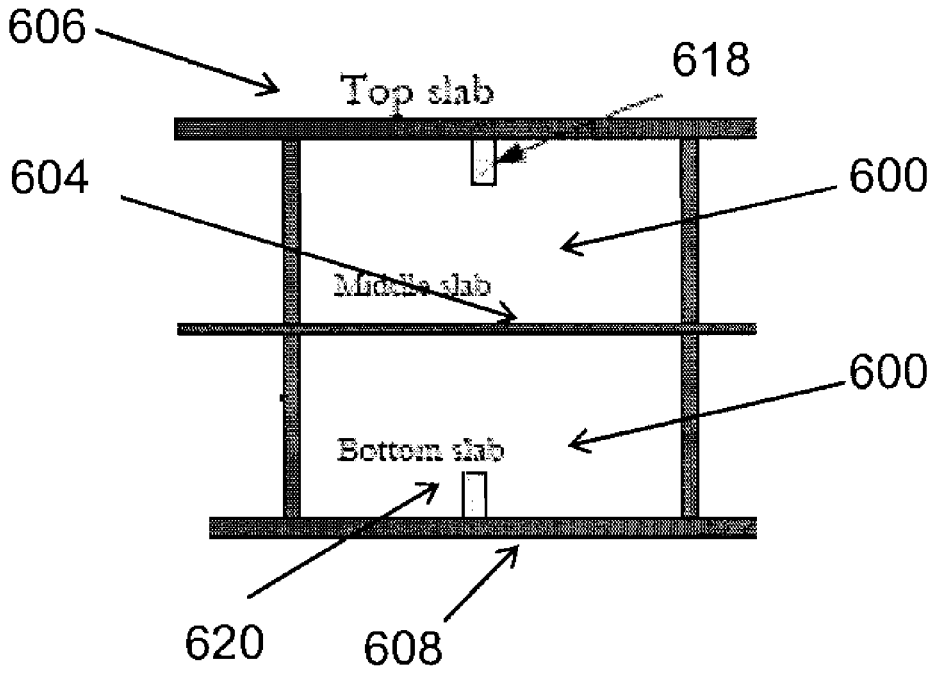
FIG. 6*a* is a schematic cross sectional view of a water tight chamber of the floating structure of FIG. 5.
Figure 6B:
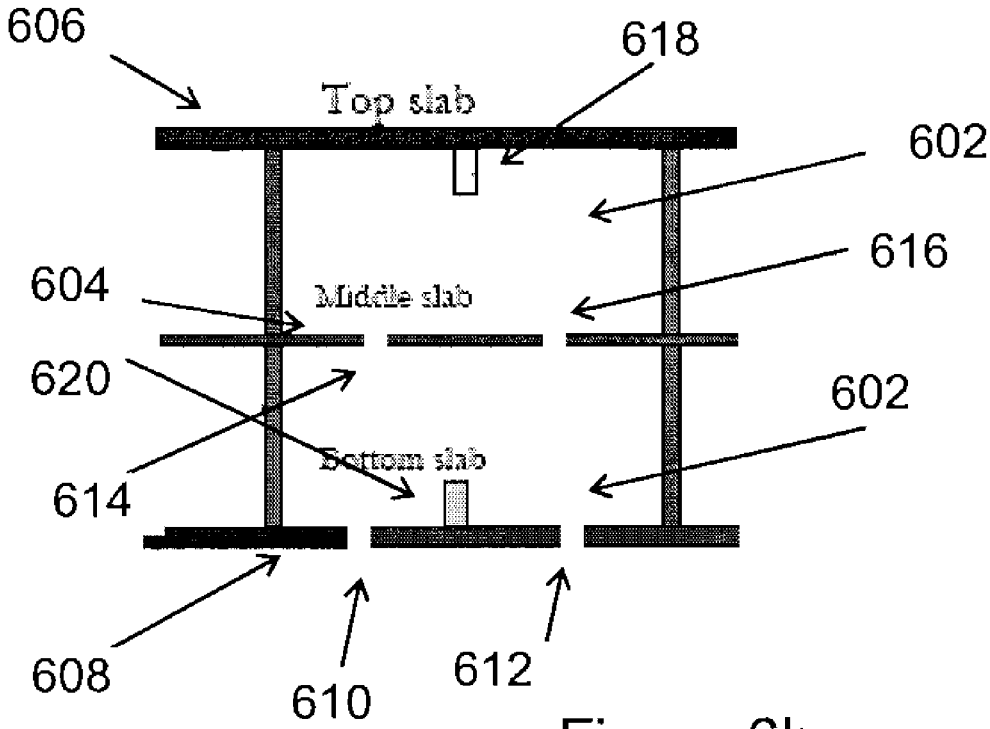
FIG. 6*b* is a schematic cross sectional view of a zero-buoyancy chamber of the floating structure of FIG. 5.

For the calculations, the structure 500 is assumed to be of a double layer structure, which will now be briefly described. FIGS. 6*a* and *b* show schematic cross-sectional views of a water tight chamber 600, and a zero-buoyancy chamber 602 of the structure 500 (FIG. 5) respectively. In FIG. 6*a*, the water tight chamber 600 is partitioned by a middle slab 604 disposed between the top and bottom slabs 606, 608 respectively. Similarly, as shown in FIG. 6*b*, the zero-buoyancy chamber 602 is partitioned by the middle slab 604 disposed between the top and bottom slabs 606, 608 respectively. Apertures 610, 612 are provided in the bottom slab 608 in areas of the zero-buoyancy chamber 602, with corresponding apertures 614, 616 provided in the middle slab 604. Beam stiffeners 618, 620 are provided underneath the top slab 606 and on top of the bottom slab 608 respectively, and extend in two orthogonal sets of horizontally spaced rows across the top and bottom slabs 606, 608.

Table 1 summarises the data adopted for the calculation including the dimensions and construction material properties of the example floating structure, the selfweight and weight of quay cranes.

TABLE 1

Data Adopted for Calculation

| | Data | Units |
|---|---|---|
| Dimensions of Floating Structure | | |
| Total length | 470 | m |
| Total width | 520 | m |
| Total height | 10 | m |
| Thickness of top and bottom slabs | 0.4 | m |
| Thickness of intermediate level slab | 0.2 | m |
| Thickness of vertical walls | 0.3 | m |
| Width of beam stiffeners | 0.5 | m |
| Depth of beam stiffeners | 1.0 | m |
| Material Properties and Allowable Stresses | | |
| Density of high performance concrete | 1900 | kg/m³ |
| Modulus of high performance concrete | 22.9 | GPa |
| Poisson's ratio of high performance concrete | 0.2 | |
| Compressive stress | 70 | MPa |
| Flexural tensile stress | 7.2 | MPa |
| Splitting tensile stress | 4.3 | MPa |
| Allowable compressive stress | 42 | MPa |
| Allowable flexural tensile stress | 4.32 | MPa |
| Allowable splitting tensile stress | 2.58 | MPa |
| Dead Loads | | |
| Total selfweight of container terminal | 737250 | ton |
| Weight of one quay crane | 1360 | ton |
| Number of quay cranes | 8 | |

ABAQUS software was used for the calculation. The model for the calculation consists of

- 4-node thin-plate elements for the top, middle and bottom slabs and the vertical walls. Each element for the slab has dimensions 5 m×5 m with different thicknesses and each element for the vertical wall has dimensions 5 m×4.8 m
- 2-node beam elements for modelling the beam stiffeners. Each beam stiffener has a length of 5 m.
- Lateral springs are attached to the nodes of the bottom plate elements to model the buoyancy forces. The spring coefficient is taken as 250 kN/m (=1.03×9.81×5×5), which is equivalent to the buoyancy force.

Figure 7:
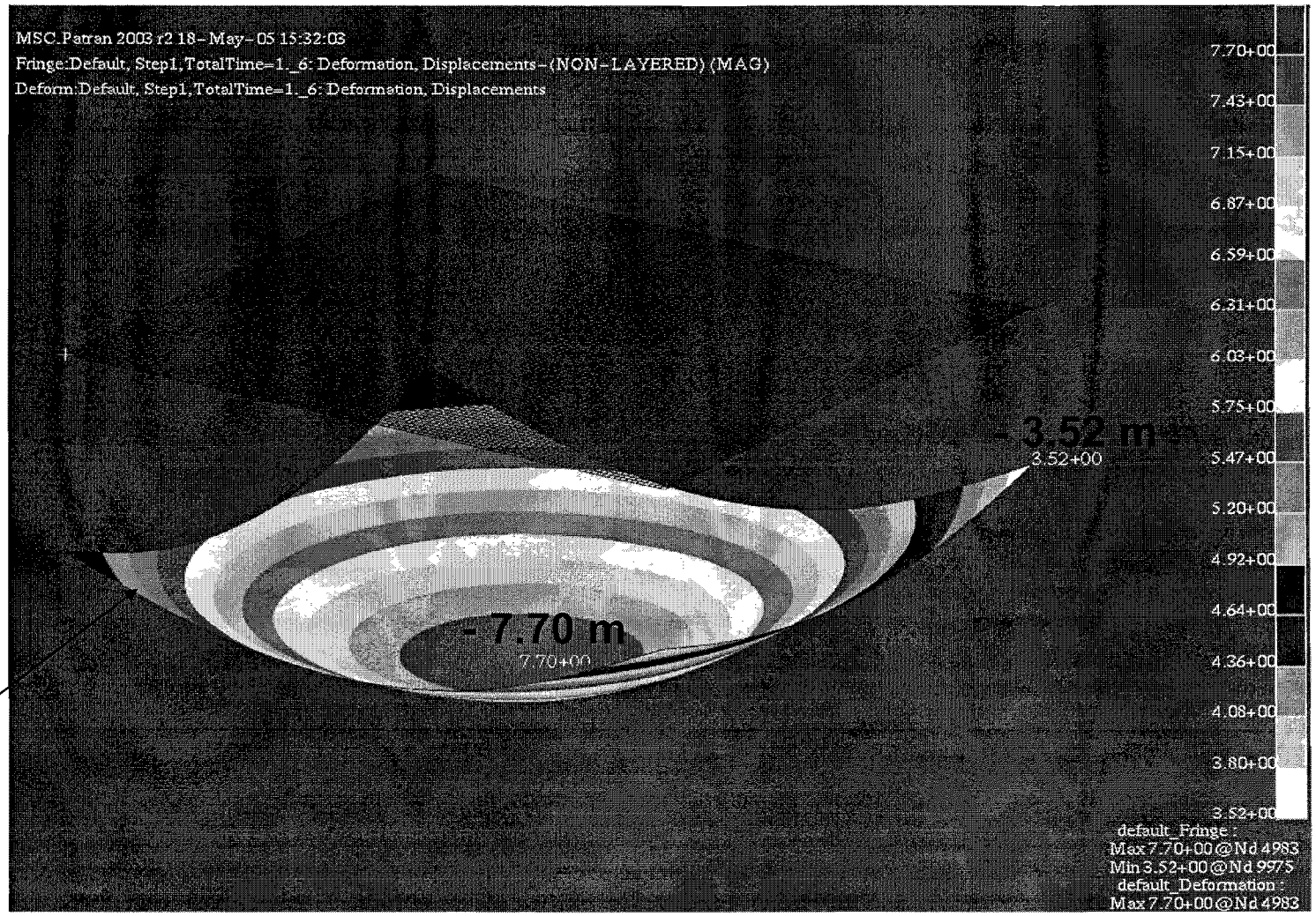
FIG. 7*a* shows a deflection surface of a floating structure without zero-buoyancy chambers and subjected to a 7-tier container loading (deflections in metres).
FIG. 7*b* shows a deflection surface for the floating structure of FIG. 5 and subjected to a 7-tier container loading (deflections in metres).
Figure 7:
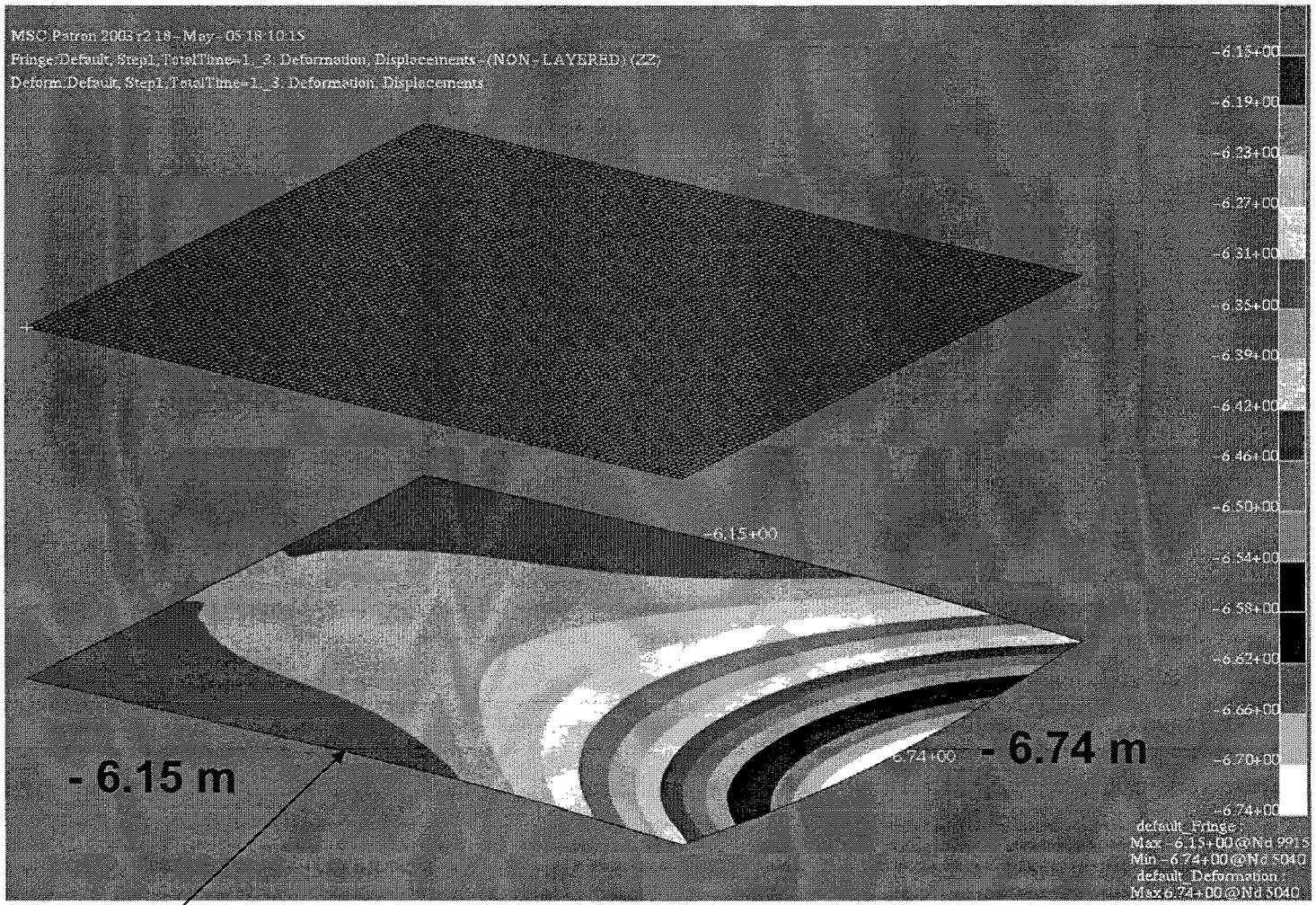

FIGS. 7*a* and *b* show the calculated deflection surfaces 700, 702 for the floating structure without zero-buoyancy chambers, and with zero-buoyancy chambers according to the example embodiment, respectively. The deflection surfaces 700, 702 were calculated under 7-tier container loading, and the quay crane load and the terminal selfweight as listed in Table 1. As can be seen from a comparison of FIGS. 7*a* and *b*, the floating structure in accordance with the example embodiment (FIG. 7*b*) experiences significantly reduced differential deflection of the floating structure, as illustrated by the substantially "flat" deflection surface 702.

Figure 8A:
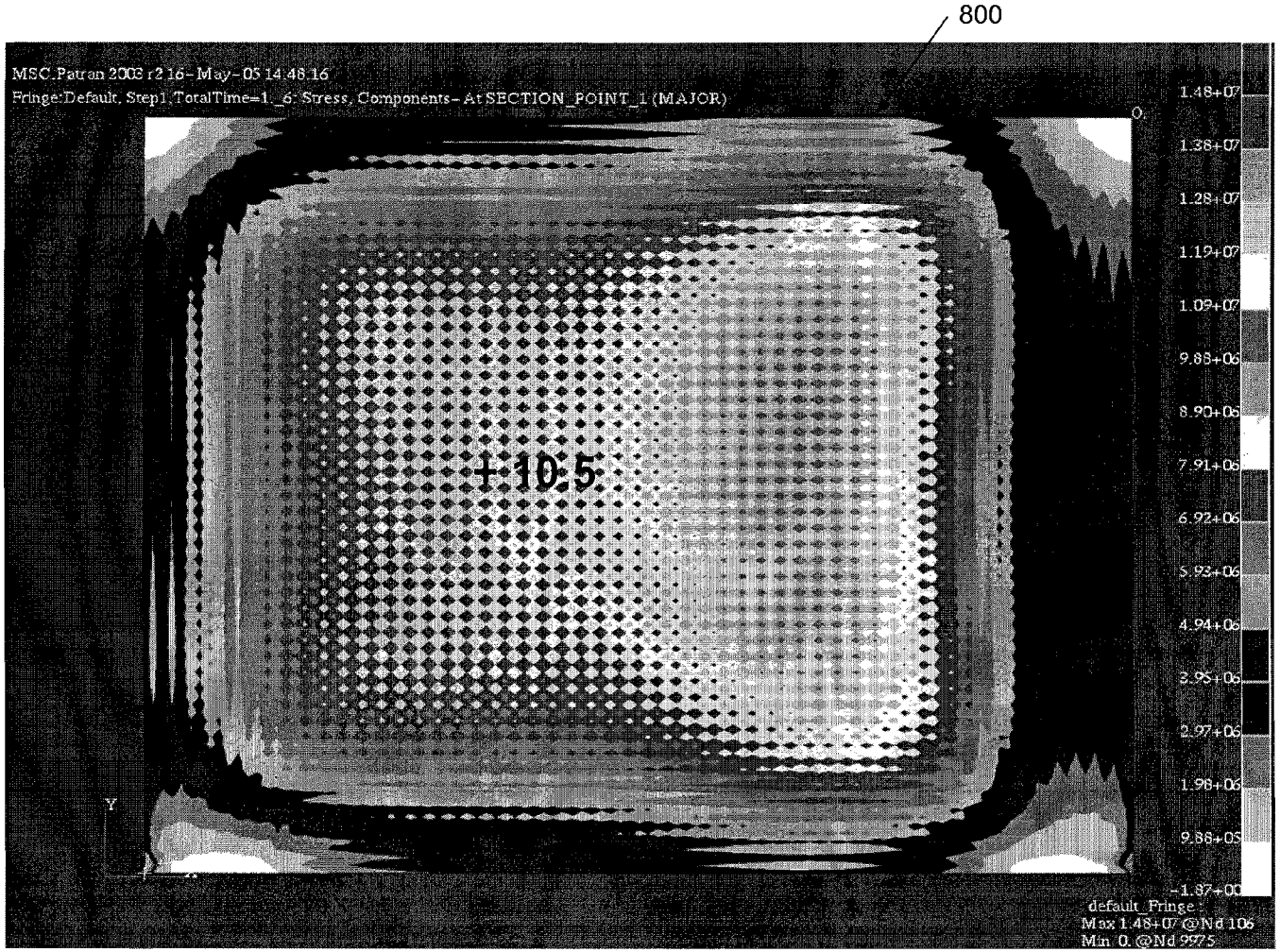
FIG. 8*a* shows a stress contour of a bottom slab for the major principal stresses in a floating structure without zero-buoyancy chambers and subjected to a 7-tier container loading (stresses in MPa).
Figure 8:
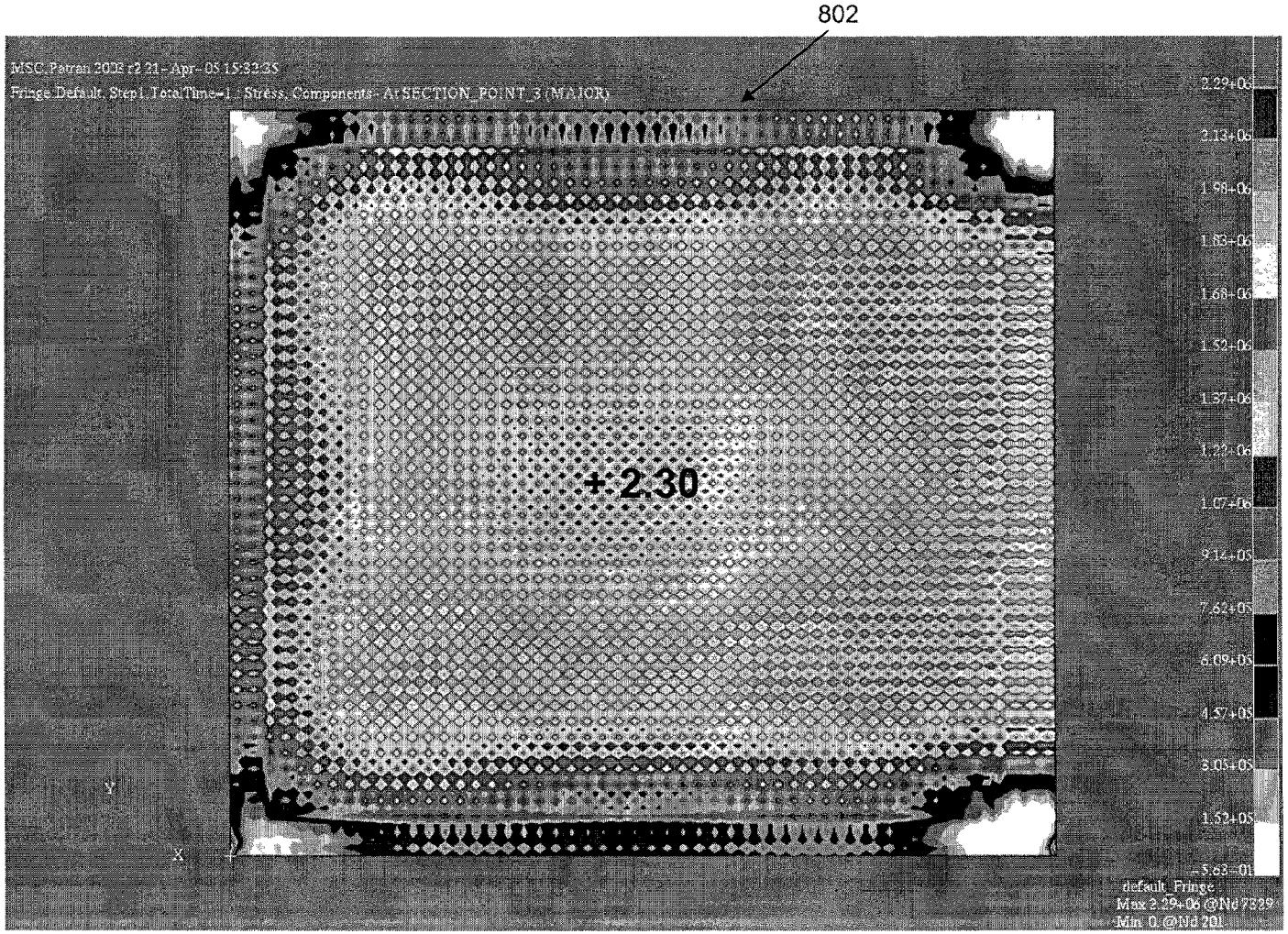
FIG. 8*b* shows a stress contour of the bottom slab for the major principal stresses in the floating structure of FIG. 5 and subjected to a 7-tier container loading (stresses in MPa).

FIGS. 8*a* and *b* show the calculated stress contours 800, 802 of the bottom slab for the major principal stresses for the floating structure without zero-buoyancy chambers, and with zero-buoyancy chambers according to the example embodiment, respectively. The stress contours 800, 802 were calculated under 7-tier container loading, and the crane load and selfweight as listed in Table 1. As can be seen from a comparison of FIGS. 8*a* and *b*, the floating structure in accordance with the example embodiment (FIG. 8*b*) experiences significantly reduced stresses.

Figure 9A:
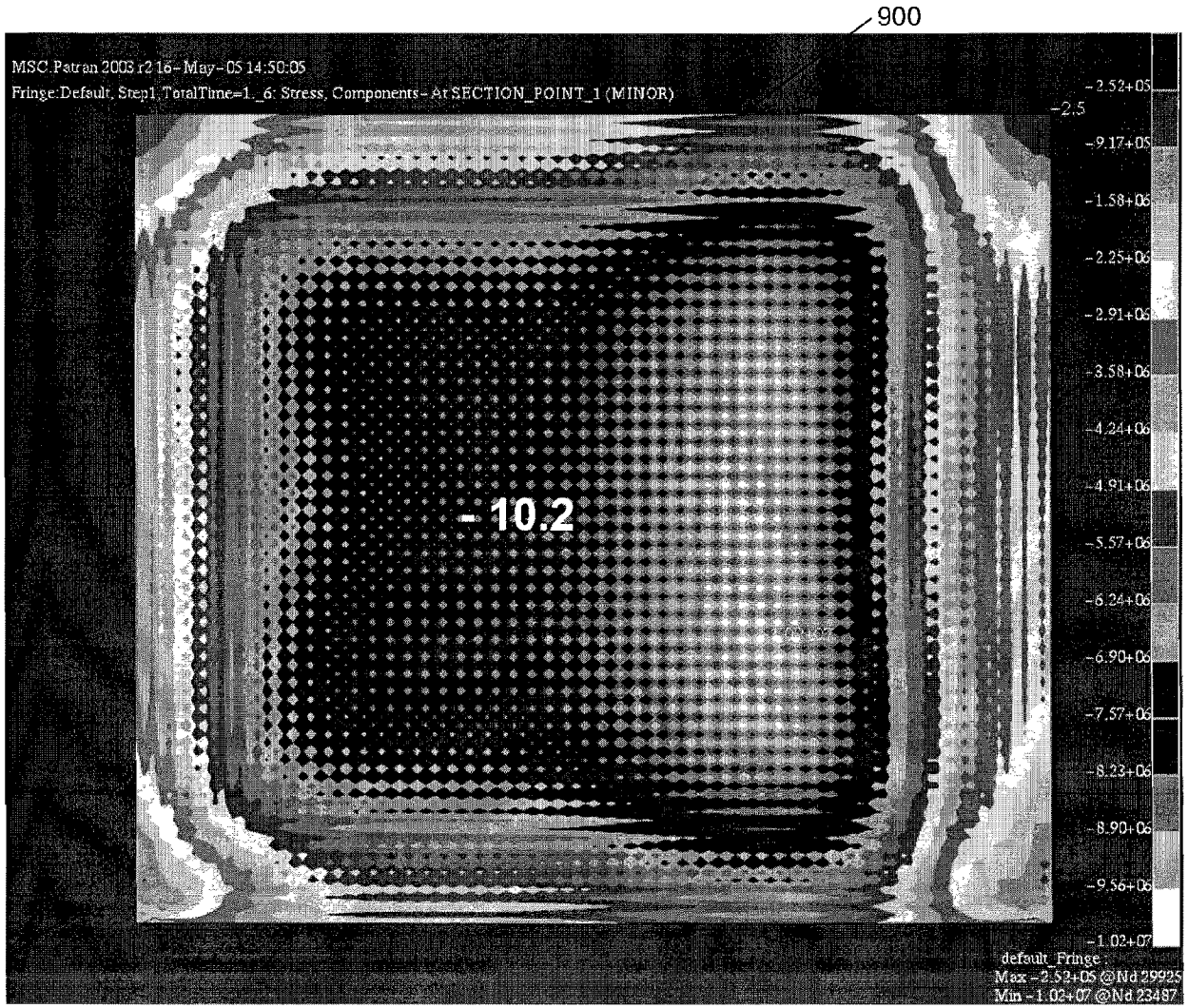
FIG. 9*a* shows a stress contour of a top slab for the major principal stresses in a floating structure without zero-buoyancy chambers and subjected to a 7-tier container loading (stresses in MPa).
Figure 9B:
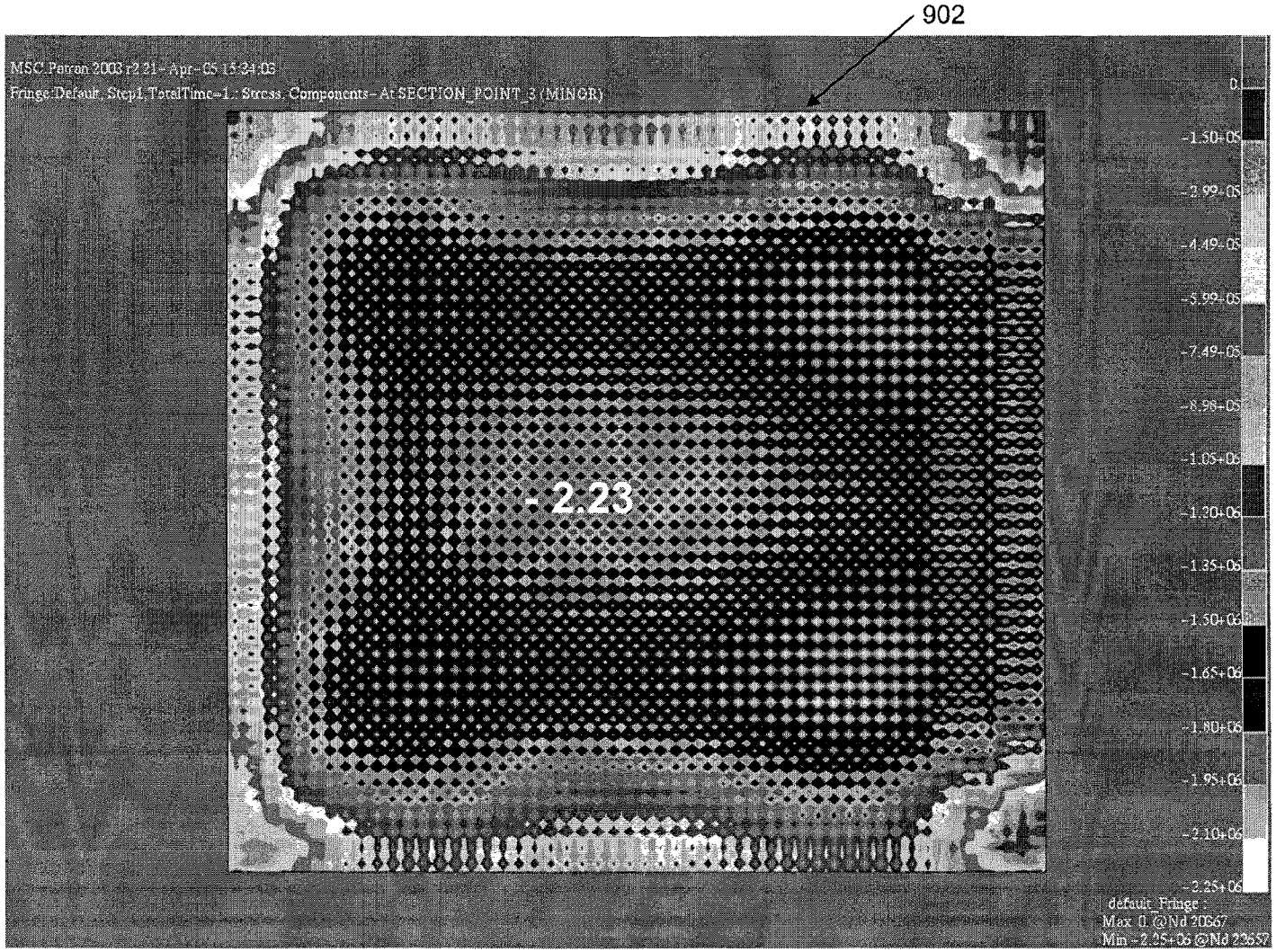
FIG. 9*b* shows a stress contour of the top slab for the major principal stresses in the floating structure of FIG. 5 and subjected to a 7-tier container loading (stresses in MPa).

FIGS. 9*a* and *b* show the calculated stress contours 900, 902 of the top slab for the major principal stresses for the floating structure without zero-buoyancy chambers, and with zero-buoyancy chambers according to the example embodiment, respectively. The stress contours 900, 902 were calculated under 7-tier container loading, and the crane load and selfweight as listed in Table 1. As can be seen from a comparison of FIGS. 9*a* and *b*, the floating structure in accordance with the example embodiment (FIG. 9*b*) experiences significantly reduced stresses.

Tables 2 and 3 summarise the deflections calculated for the floating structure without zero-buoyancy chambers, and with zero buoyancy chambers according to the example embodiment, respectively.

TABLE 2

| | Deflection (m) | | | Differential Deflection (m) | |
|---|---|---|---|---|---|
| Tiers | Corner | Edge | Centre | Corner with respect to centre | Edge with respect to centre |
| 0 | −3.53 | −3.06 | −2.89 | −0.64 | −0.17 |
| 1 | −3.43 | −3.62 | −3.58 | 0.15 | −0.04 |
| 2 | −3.53 | −3.85 | −4.26 | 0.73 | 0.41 |
| 3 | −3.53 | −4.27 | −4.95 | 1.42 | 0.68 |
| 4 | −3.53 | −4.67 | −5.64 | 2.11 | 0.97 |
| 7 | −3.52 | −5.90 | −7.70 | 4.18 | 1.8 |
| Allowable Deflection | −7.5 | −7.5 | | | |
| Draft Check | OK since deflection is less than allowable deflection | | | | |

TABLE 3

| | Deflection (m) | | | Differential Deflection | |
|---|---|---|---|---|---|
| Tiers | Corner | Edge | Centre | Corner w.r.t. centre (m) | Edge w.r.t. centre (m) |
| 5 | −6.15 | −6.74 | −6.27 | 0.12 | −0.47 |
| 6 | −6.48 | −7.02 | −6.93 | 0.45 | −0.09 |
| 7 | −6.69 | −7.15 | −7.61 | 0.92 | 0.46 |

TABLE 3-continued

| Tiers | Deflection (m) Corner | Deflection (m) Edge | Deflection (m) Centre | Differential Deflection Corner w.r.t. centre (m) | Differential Deflection Edge w.r.t. centre (m) |
|---|---|---|---|---|---|
| Allowable Deflection | −7.5 | −7.5 | | | |
| Draft Check | OK since deflection is less than allowable deflection | | | | |

ADVANTAGES

The zero-buoyancy chambers in example embodiments are passive since the water flows in and out naturally from the chambers. There may be no need for pumps and expensive operating costs as in an active ballast system. The zero-buoyancy chambers may allow the floating structure to have the same draft even when loaded unevenly, provided the acceptable draft is not exceeded. This may lead to cost savings because of uniformity of modules across the whole floating structure. The lower buoyancy chambers may lead to a lighter and cheaper floating structure since the thickness of structural sections may be reduced (due to the reduced stresses and differential deflection) without compromising on the serviceability and strength capacities. The lower buoyancy chambers, being partially filled with water, may also provide hydrodynamic damping, thereby making the floating structure more resistant to movement caused by wave forces and water currents.

INDUSTRIAL APPLICABILITY

Embodiments may be used in

- a floating container terminal, a floating cruise centre, a floating hotel, a floating restaurant, a floating pier/berth or a floating airport,
- mooring buoys,
- spars,
- semi-submersibles,
- rafts or mat foundations on soft soils, and
- other floating structures such as multi-body floating structures, and comb-type floating structures.

It will be appreciated by a person skilled in the art that numerous variations and/or modifications may be made to the present invention as shown in the example embodiments without departing from the spirit or scope of the invention as broadly described. The example embodiments are, therefore, to be considered in all respects to be illustrative and not restrictive.

The invention claimed is:

1. A pontoon-type floating structure comprising:

an upper deck that is to be maintained above water level and that is to receive and support a load by the load resting thereon, the upper deck having dimensions such that corners of the upper deck are vertically displaceable relative to a centre of the upper deck under forces exerted by the load on said centre thereon; and a horizontal array of chambers disposed underneath the upper deck, with the chambers providing a first set of chambers that provide the structure with buoyancy, and a second set of chambers with water having access thereto so that the second set of chambers, under steady state conditions, do not provide buoyancy;

wherein the second set of chambers is configured to limit a vertical displacement of the corners of the upper deck relative to the centre of the upper deck when the load is applied on the upper deck proximate said centre of the upper deck compared to a structure in which only buoyancy providing chambers are disposed underneath the upper deck.

2. The structure of claim 1, wherein a plurality of walls depend from the upper deck and co-operate therewith to provide the chambers separated by the walls.

3. The structure of claim 2, wherein said walls are generally perpendicular to said deck, with the walls including a first set that are generally parallel and transversely spaced and a second set, with the walls of the second set being generally parallel and transversely spaced and generally normal to the first set so that the chambers in horizontal transverse cross-section are generally square or rectangular.

4. The structure of claim 1, wherein the chambers have respective bottom walls, the bottom walls being displaced from the upper deck, with the bottom walls of said second set of chambers having an aperture providing for the flow of water.

5. The structure of claim 1, wherein said second set of chambers are located adjacent a periphery of said structure.

6. The structure of claim 5, wherein said second set of chambers are aligned in rows adjacent said periphery.

7. The structure of claim 6, wherein each row is displaced from the periphery by at least one chamber of the first set.

8. The structure of claim 6, wherein said structure is square or rectangular in configuration when viewed in plan so as to have four sides, with each row extending generally parallel to one of said sides.

9. The structure of claim 1, wherein said structure is formed of one or more of a group consisting of steel, concrete, and reinforced concrete.

10. The structure of claim 1, wherein said structure includes a generally horizontally oriented bottom slab that is to be submerged and that is generally parallel and co-terminus with respect to said upper deck but vertically spaced therefrom.

11. A pontoon-type floating structure comprising:

an upper deck that is to be maintained above water level and that is to receive and support a load by the load resting thereon, the upper deck having dimensions such that corners of the upper deck are vertically displaceable relative to a centre of the upper deck under forces exerted by said load; and a horizontal array of chambers disposed underneath the upper deck, with the chambers providing a first set of chambers that provide the structure with buoyancy, and a second set of chambers with water having access thereto so that the second set of chambers, under steady state conditions, do not provide buoyancy;

wherein the second set of chambers is configured to limit a vertical displacement of the corners of the upper deck relative to the centre of the upper deck compared to a structure in which only buoyancy providing chambers are disposed underneath the upper deck, and wherein said array of chambers is a first array, and said structure includes a second horizontal array of chambers located beneath the first array of chambers, the first and second arrays of chambers separated by a generally horizontally oriented middle slab and that is generally parallel and co-terminus with respect to said upper deck but vertically spaced therefrom.

12. The structure of claim 1, wherein said upper deck has at least one aperture, is air pervious, or has at least one aperture and is air pervious to provide for the flow of air with respect to the chambers of the second set.

13. The structure of claim 2, wherein the chambers have respective bottom walls, the bottom walls being displaced from the upper deck, with the bottom walls of said second set of chambers having an aperture providing for the flow of water.

14. The structure of claim 3, wherein the chambers have respective bottom walls, the bottom walls being displaced from the upper deck, with the bottom walls of said second set of chambers having an aperture providing for the flow of water.

15. The structure of claim 2, wherein said second set of chambers are located adjacent a periphery of said structure.

16. The structure of claim 3, wherein said second set of chambers are located adjacent a periphery of said structure.

17. The structure of claim 4, wherein said second set of chambers are located adjacent a periphery of said structure.

18. The structure of claim 7, wherein said structure is square or rectangular in configuration when viewed in plan so as to have four sides, with each row extending generally parallel to one of said sides.

19. The structure of claim 2, wherein said structure is formed of one or more of a group consisting of steel, concrete, and reinforced concrete.

20. The structure of claim 3, wherein said structure is formed of one or more of a group consisting of steel, concrete, and reinforced concrete.

21. The structure of claim 11, wherein the chambers have respective bottom walls, the bottom walls being displaced from the upper deck, with the bottom walls of said second set of chambers having an aperture providing for the flow of water.

22. The structure of claim 11, wherein said second set of chambers are located adjacent a periphery of said structure.

23. The structure of claim 22, wherein said second set of chambers are aligned in rows adjacent said periphery.

24. The structure of claim 23, wherein each row is displaced from the periphery by at least one chamber of the first set.

25. The structure of claim 23, wherein said structure is square or rectangular in configuration when viewed in plan so as to have four sides, with each row extending generally parallel to one of said sides.

* * * * *